US005190176A

United States Patent [19]

Lavange

[11] Patent Number: 5,190,176

[45] Date of Patent: Mar. 2, 1993

[54] CHILD RESISTANT CLOSURE WITH PROTECTIVE FLANGE AND CANTED UPPER WALL

[75] Inventor: Donald H. Lavange, Cumberland, R.I.

[73] Assignee: Polytop Corporation, Slatersville, R.I.

[21] Appl. No.: 814,696

[22] Filed: Dec. 30, 1991

[51] Int. Cl.[5] ..... B65D 47/06; B65D 55/02

[52] U.S. Cl. ..... 215/235; 215/201; 215/236; 215/240; 215/305; 222/534

[58] Field of Search ..... 215/201, 202, 203, 204, 215/215, 227, 235, 236, 239, 240, 305; 222/530, 534, 538, 556

[56] References Cited

U.S. PATENT DOCUMENTS

| | | | |
|---|---|---|---|
| 3,318,494 | 5/1967 | Porter et al. | 222/534 |
| 3,495,745 | 2/1970 | Akers | 222/534 |
| 3,655,099 | 4/1972 | Hazard | 222/534 X |
| 3,718,238 | 2/1973 | Hazard et al. | 222/538 X |
| 3,881,643 | 5/1975 | La Vange | 222/534 X |
| 3,957,181 | 5/1976 | Hazard | 222/534 |
| 4,047,643 | 9/1977 | Hazard | 222/534 X |
| 4,081,113 | 3/1978 | Hazard | 222/534 |
| 4,732,303 | 3/1988 | Wang | 222/534 X |
| 4,756,451 | 7/1988 | Wilson | 222/534 |
| 4,763,801 | 8/1988 | Nycz | 215/203 |

FOREIGN PATENT DOCUMENTS

| | | | |
|---|---|---|---|
| 258058 | 3/1965 | Australia | 222/534 |
| 0402550 | 12/1990 | European Pat. Off. | 222/534 |

*Primary Examiner*—Allan N. Shoap
*Assistant Examiner*—Vanessa Caretto
*Attorney, Agent, or Firm*—Hoffman, Wasson & Gitler

[57] ABSTRACT

A child resistant dispensing closure having a cap and a spout mounted thereon for rotation about a substantially horizontal axis. The upper surface of the spout is provided with a plurality of ribs, each of which has a distinct energy plane. Only one rib, usually, the rearmost, allows sufficient purchase to produce the force vector necessary to initiate rotation of the spout when a manual force is applied thereto. The cap includes a cylindrical skirt with a frusto-conical section extending upwardly therefrom. A protective flange extends upwardly about the perimeter of the upper end of the frusto-conical section to deter unauthorized access to the spout. The upper wall of said cap is canted at an acute angle to a horizontal plane passing through the cylindrical skirt of the cap, so that the spout is further recessed within the protective flange.

3 Claims, 3 Drawing Sheets

CHILD RESISTANT CLOSURE WITH PROTECTIVE FLANGE AND CANTED UPPER WALL

BACKGROUND OF THE INVENTION

1. Field of the Invention

This invention pertains broadly to child resistant dispensing closures. More particularly, this invention relates to a child resistant dispensing closure including a cap and a spout, wherein the spout is rotatably mounted within a cavity formed in the cap. A passageway extends axially through the spout, and the cap is secured to a container. The spout can be manually rotated between (1) an open position in which the passageway in the spout is aligned with an opening through the top of the cap, so that the contents of the container can be discharged, and (2) a closed position in which the spout closes off the opening through the cap and precludes discharge.

2. Potential Classification

Child resistant closures may be found in Class 215, subclass 201+. Dispensers with spouts are found in Class 222, subclass 534+.

3. Description of the Prior Art

Dispensing closures of the type having a cap and a rotatable spout, are known in the prior art. One example of such prior art closures is shown in U.S. Pat. No. 4,209,114, issued on Jun. 24, 1980, to Woodrow S. Wilson et al. The Wilson et al patent is directed to a dispensing closure including a cap member which is provided with aligned bearings and a rotatable spout having trunnions fitting within the bearings. However, such dispensing closure tended to be relatively easy to open, and thus presented limited protection against unauthorized access by children or other individuals of reduced mental capacity who could not recognize the potential danger of the product that could be discharged through the spout.

Consequently, to satisfy safety concerns expressed by government agencies, private organizations concerned with child safety and health issues, and the safety-conscious public, inventors attempted to provide child resistant features on dispensing closures of the rotatable spout type. Illustrative child resistant closures are set forth in U.S. Pat. No. 3,957,181, issued May 18, 1976, to Robert Hazard, and in U.S. Pat. No. 4,756,451, issued Jul. 12, 1988, to Woodrow S. Wilson.

U.S. Pat. No. 3,957,181 discloses a child resistant dispensing closure having a spout which fits entirely within an elongated groove in a cap when the spout is in a closed position. The end of the spout which is normally engaged to move the spout between open and closed positions is located within the groove. Spout movement is initiated by applying pressure to a portion of the spout remote from the latter end of the spout.

U.S. Pat. No. 4,756,451 discloses a child resistant dispensing closure having a cap 12 and a spout 14 mounted thereon for rotation about a substantially horizontal axis defined by trunnions 48 and bearing openings 38. The upper surface of the cap is provided with a pattern of ribs 35, as shown in FIG. 2. The upper surface 53 of the spout is provided with a plurality of ribs 52, 54, 56 and 58, each of which has a distinct energy plane. All but one of the energy planes fails to allow sufficient purchase on their respective ribs to produce the proper force vector required to initiate rotation of the spout, when a manual force is applied thereto.

The plurality of ribs provided on the spout, in conjunction with the pattern of ribs provided on the cap, blend together and distract or confuse a child or adult of reduced mental capacity. Consequently, the chances for a child to inadvertently discover the sole energy plane capable of realizing rotation of the spout, while exploring same with the fingers, fingernails, teeth, or a tool, are greatly reduced. However, the dispensing closure may still be readily opened by an adult following appropriate instructions.

The foregoing child resistant dispensing closures have solved some, but not all, of the problems associated with child resistant dispensing closures. For example, in some instances, the pattern of ribs on the spout and an upper surface of the dispensing closure of U.S. Pat. No. 4,756,451 defeated inadvertent openings by children, but also confused adult users, as well. Difficulty was encountered in identifying and manipulating the one rib, with the appropriate energy plane, for moving the spout from its normally closed position in a recess formed in the upper wall of the dispensing closure.

Consequently, the prior art has failed to provide a rotatable spout dispensing closure that is efficient and nearly fool-proof from a child safety viewpoint, but which is susceptible of easy operation by adults. Furthermore, such rotatable spout dispensing closure must be readily molded in multiple cavity molds, within close tolerances, so that such closures can be sold at low costs compatible with mass marketing techniques. Lastly, since the dispensing closure is usually employed with a product that is used in the home, such closure must be aesthetically pleasing and easily cleaned, so that product residue does not accumulate on visible surfaces.

SUMMARY OF THE INVENTION

Against this backdrop of known, child resistant dispensing closures, the present invention is characterized by, inter alia, a protective flange that extends around the perimeter of the upper surface of the cap. Such protective flange is integrally molded with the dispensing closure, and is of sufficient height, strength, and rigidity to inhibit a child, or adult of limited mental capacity, from inadvertently rotating the spout, out of its normally closed position, by biting same with one's teeth. Since the protective flange extends above the upper surface of the cap, the spout and the upper surface of the cap are normally maintained in a recessed, protected position.

The cap of the present invention includes a lower cylindrical section and an upper section, said upper section being characterized by a frusto-conical shape that embraces an upper wall that is disposed at an acute angle to a horizontal plane passing through the cap. The upper wall has a reduced surface area that inhibits unwarranted openings of the spout. Furthermore, when the spout is rotated into its open position, the spout is located at an acute angle to a horizontal plane. Such orientation is advantageous when the dispensing closure is used to discharge cleaning fluids, or the like, under the rim of a toilet bowl, onto slanted automobile windshields, onto overhead fixtures, etc.

Other advantages realized by the child resistant dispensing closure, with its unique cap using a protective flange and a canted upper wall, in combination with multiple rib patterns, and other child resistant features, will become readily apparent to the skilled artisan when the appended drawings are construed in harmony with the ensuing specification.

BRIEF DESCRIPTION OF THE DRAWINGS

Further details of the present invention are best expressed with reference to the accompanying drawings wherein.

DETAILED DESCRIPTION OF THE PREFERRED EMBODIMENT

Referring now to FIGS. 1–4, such drawings depict a dispensing closure 10 comprising a cap 12 and a spout 14. These components can be formed in a durable, abrasion resistant plastic, by conventional high-speed, multiple-cavity injection molding machines.

Figure 2:
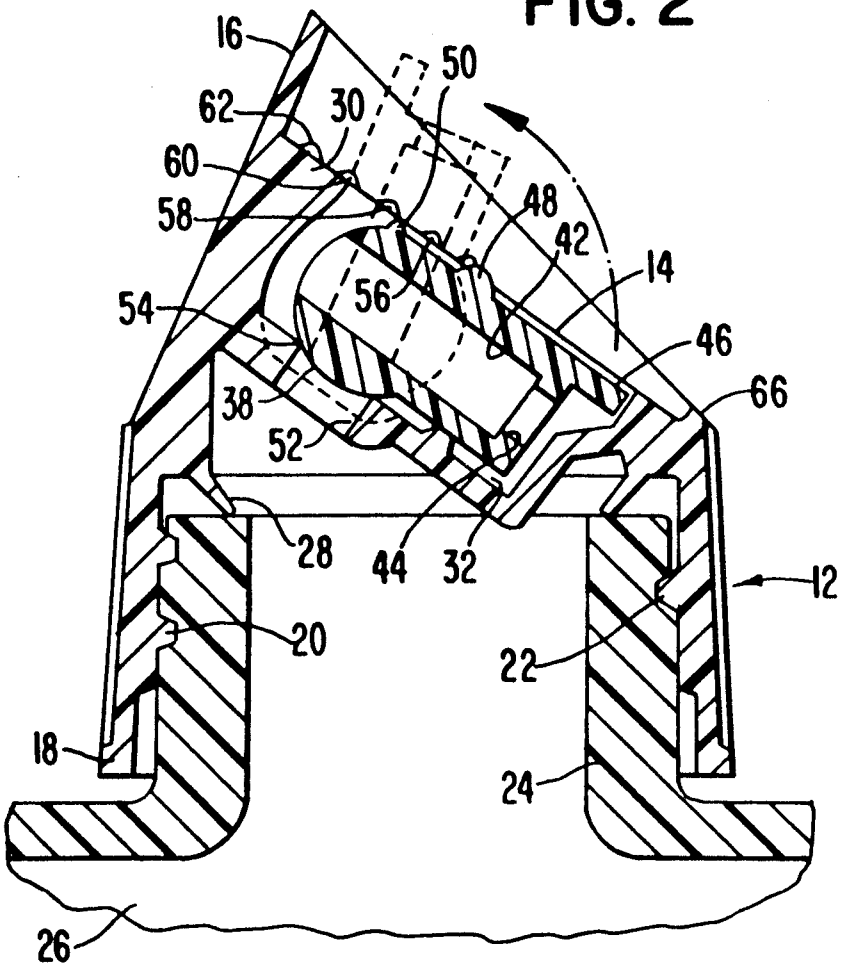
FIG. 2 is a vertical cross-sectional view of the dispensing closure and container of FIG. 1, such view being taken along line 2—2 in FIG. 1 and in the direction indicated.

Cap 12 includes a frusto-conical upper section 16 and a lower, cylindrical skirt 18. Threads 20 extend inwardly from skirt 18, and coact with complementary grooves 22 on neck 24 of container 26, to secure the cap in fixed position upon the neck of the container. Only a fragment of container 26 is shown. A flange seal 28 on the cap contacts the upper surface of the neck of the container 26 when the cap is secured thereto, as shown in FIG. 2.

The upper wall 30 of the frusto-conical section 16 of cap 12 has a cavity 32 molded therein. Cavity 32 is configured to receive spout 14 therein, when the spout is in its closed position.

Figure 3:
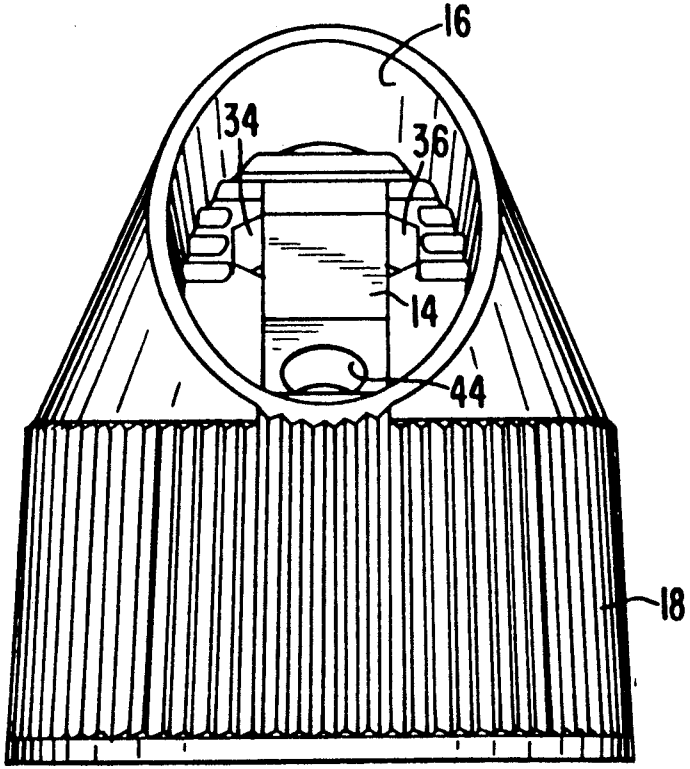
FIG. 3 is a front elevational view of the dispensing closure of FIG. 1.

As shown in FIG. 3, trunnions 34,36 are formed on opposite sides of the cylindrical base 38 of spout 14. The trunnions fit into bearing openings 40 formed in the upper wall 30 of cap 12, so that spout 14 can be rotated through an arc of 90°, as suggested by the directional arrow in FIG. A passageway 42 extends axially throughout spout 14, and terminates at its upper end in a discharge opening 44. A ledge 46 projects beyond the discharge opening, and enables the user to apply force to the spout to rotate same to its upright, open position once the spout has been elevated, or raised, out of its normal closed position within the cavity 32 in upper wall 30 of the cap.

Ribs 48,50 are formed on the upper surface of spout 14 in the vicinity of the enlarged, cylindrical base. The rear rib 50 is so configured that the application of manual pressure thereto, as by a fingernail or coin, is sufficient to rotate the discharge end of spout 14 partially out of cavity 32. Then, by manipulating ledge 46, the spout can be rotated approximately 90° to its opened position, shown in dotted outline in FIG. 2. The forward rib 48 serves as a decoy to deter unauthorized opening of closure 10.

An aperture 52 opens upwardly into cavity 32 in upper wall 30, and the passageway 42 in spout 14 is aligned with aperture 52 only when the spout assumes its upright, opened position. Bearing surface 54 surrounds the upper end of aperture 52 and permits the cylindrical base of the spout to be rotated relative thereto.

Figure 1:
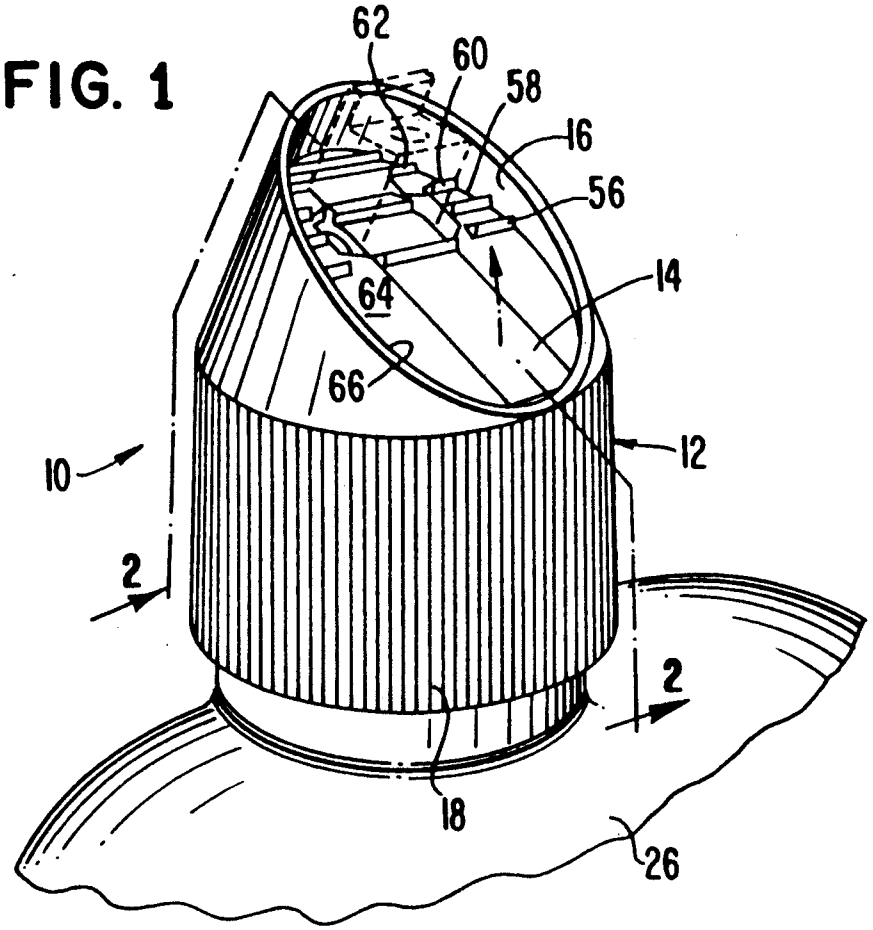
FIG. 1 is a perspective view of a preferred embodiment of a child resistant dispensing closure, constructed in accordance with the principles of the present invention, secured to the neck of a container.
Figure 4:
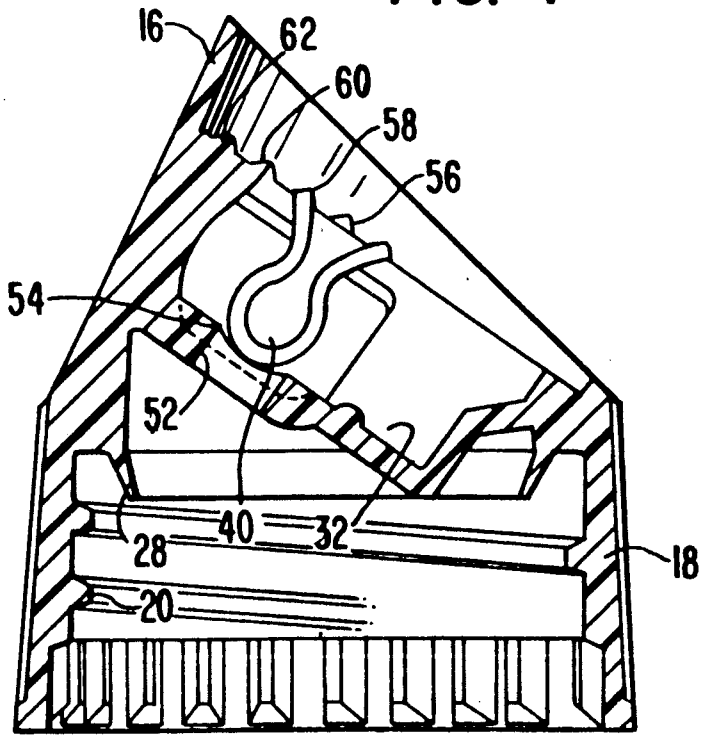
FIG. 4 is a vertical cross-sectional view of the dispensing closure of FIGS. 1–3, with the spout removed, to show the bearing openings.

Pairs of ribs 56, 58, 60 and 62 are located on opposite sides of spout 14, as shown in FIG. 1. The pairs of ribs may be in alignment with ribs 48,50 on spout 14, or may be offset therefrom. In either event, the distribution of the ribs, and the multiplicity thereof, deter inadvertent opening of the closure.

The frusto-conical section 16 of closure 12 tapers inwardly as it rises above cylindrical skirt 18. Consequently, the exposed area of the upper surface 64 of the upper wall is less than the area circumscribed by a horizontal plane passing through skirt 18.

Furthermore, upper wall 30 is canted, at an acute angle, to a horizontal plane passing through skirt 18. A protective flange 66 extends about the perimeter of the upper surface 64 of upper wall 30, and defines a recess that protects the ribs 48,50 on spout 14 from unwarranted manipulation. The location of the ribs 48,50 within the recess, the height and relative strength of protective flange 66, the reduced area of upper surface 64, and the angled disposition of upper wall 30 canted relative to a horizontal plane, all function in harmony to enhance the effectiveness of the preferred embodiment of the child resistant dispensing closure shown in FIGS. 1–4.

ALTERNATIVE EMBODIMENT

Figure 6:
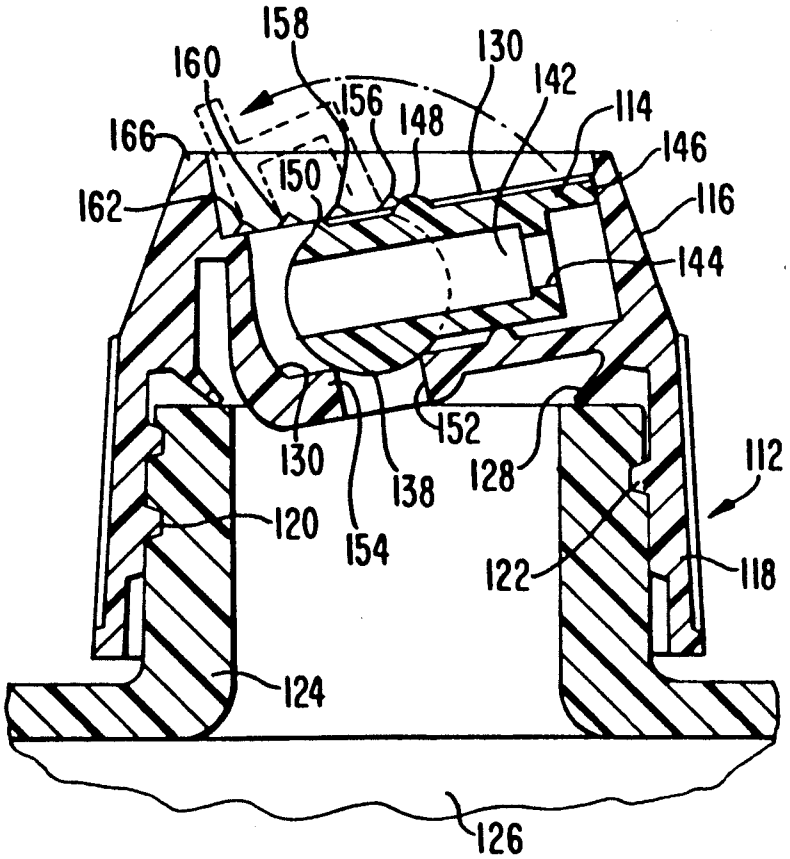
FIG. 6 is a vertical cross-sectional view of the dispensing closure and container of FIG. 5, such view being taken along line 6—6 in FIG. 5 and in the direction indicated.
Figure 5:
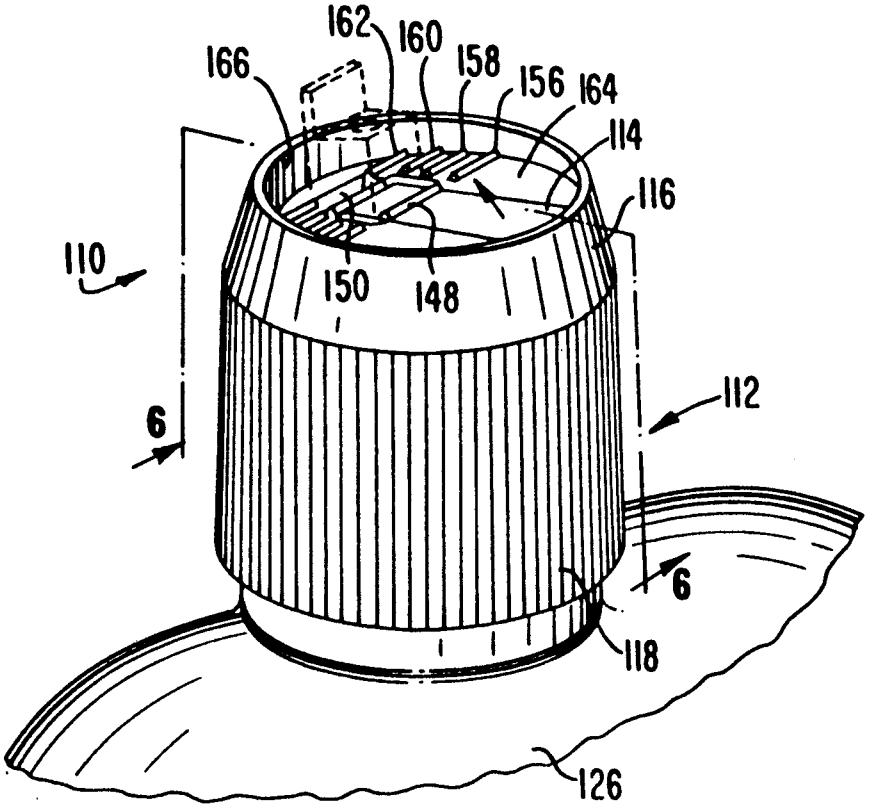
FIG. 5 is a perspective view of an alternative embodiment of the child resistant dispensing closure constructed in accordance with the principles of the present invention, secured to the neck of a container.

FIGS. 5 and 6 depict an alternative embodiment of the child resistant dispensing closure, such closure being identified, generally, by reference numeral 110. Closure 110 comprises a cap 112, and a spout 114.

Cap 112 includes a frusto-conical upper section 116 and a lower, cylindrical skirt 118. Threads 120 extend inwardly from skirt 118, and coact with complementary grooves 122 on neck 124 of container 126 to secure the cap in fixed position upon the neck of the container. Only a fragment of container 126 is shown. A flange seal 128 on the cap contacts the upper surface of the neck of the container when the cap is secured thereto, as shown in FIG. 6.

The upper wall 130 of the frusto-conical section 116 of cap 112 has a cavity 132 molded therein. Cavity 132 is configured to receive spout 114 therein, when the spout is in its closed position.

Trunnions (not visible in FIGS. 5 and 6) are formed on opposite sides of the cylindrical base 138 of spout 114. The trunnions fit into bearing openings (also nor shown) formed in the upper wall 130 of cap 112, so that spout 114 can be rotated through an arc of 90°, as suggested by the directional arrow in FIG. 6. A passageway 142 extends axially through spout 114, and terminates at its upper end in a discharge opening 144. A ledge 146 projects beyond the discharge opening, and enables the user to apply force to the spout to rotate same to its upright, open position, once the spout has been elevated, or raised, out of its normal closed position within the cavity 132 in upper wall 130 of the cap.

Ribs 148,150 are formed on the upper surface of spout 114 in the vicinity of the enlarged cylindrical base. The rear rib 150 is so configured that the application of manual pressure thereto is sufficient to rotate the discharge end of spout 114 partially out of cavity 132. The forward rib 148 serves as a decoy.

An aperture 152 opens upwardly into cavity 132 in upper wall 130, and the passageway 142 and spout 114 is aligned with aperture 152 only when the spout assumes its upright, opened position. Bearing surface 154 surrounds the upper end of aperture 152 and permits the cylindrical base of the spout to be rotated relative thereto.

Pairs of ribs 156, 158, 160 and 162 are located on opposite sides of spout 114, as shown in FIG. 5. The pairs of ribs may be in alignment with the ribs 148,150 on the spout, or may be offset therefrom.

The frusto-conical section 116 of closure 112 tapers inwardly as it rises above cylindrical skirt 118. Consequently, the exposed area of the upper surface 164 of the upper wall is less than the area circumscribed by a horizontal plane passing through skirt 118.

Furthermore, the upper wall 130 is canted, at an acute angle, to a horizontal plane passing through skirt 118. A protective flange 166 extends about the perimeter of the upper surface 164 of upper wall 130, and defines a recess that protects the ribs 148,150 on spout 114 from unwarranted manipulation. The location of the ribs 148,150 within the recess, the height and relative strength of protective flange 166, the reduced area of upper surface 164, and the angled disposition of upper wall 130 canted relative to a horizontal plane, all function cooperatively to produce an effective, child resistant closure that is capable of application to containers dispensing a wide variety of products. Other modifications, revisions, and alterations may be made to the child resistant dispensing closures 10,110, and yet fall within the ambit of invention expressed in the appended claims. To illustrate, the ribs adjacent the spout 14,114, may be replaced by a pattern of beads or protrusions. Ribs 48, 148 may be configured so that manual pressure applied thereto will rotate the spout out of its closed position, while ribs 50, 150 may serve as a decoy. The angular orientation of upper wall 30,130 relative to a horizontal plane passing through skirt 18,118 of the cap may be varied over a wide range of values, depending upon the function assigned to the dispensing closure and associated container.

Since other modifications, revisions, and alterations may occur to the skilled artisan, the appended claims should not be limited to their literal terms, but should be broadly construed in a manner consistent with the advances in the useful arts and sciences realized by the present invention.

I claim:

1. A child resistant closure comprising:

a) a cap and a spout, b) said cap comprising an upper wall and a depending skirt, said skirt being adapted for securement to a container, c) said upper wall having a cavity defined therein to receive said spout, d) an opening formed in the upper wall of said cap for communication with said spout, e) a passage extending axially through said spout, and terminating in a discharge opening, f) said spout being mounted within said cavity in said cap for pivotal movement about a horizontal axis between a closed position wherein said spout closes off said opening in said upper wall of said cap and an open position wherein said opening and said axial passage in said spout are aligned, g) at least one rib formed on the upper surface of said spout so that manual pressure applied thereto can rotate said spout out of its closed position within said cavity in said upper wall of said cap, h) the invention being characterized by 1) said cap further including a frusto-conical section that extends upwardly above said upper wall, and said spout received in said cavity in said upper wall, 2) an upper end of said frusto-conical section terminating in a protective flange that extends around the perimeter of said frusto-conical section, 3) said protective flange being integrally formed with said cap and possessing sufficient height and structural rigidity to resist bending and thereby deter unauthorized access to said rib on said spout.

2. A child resistant dispensing closure as defined in claim 1 further characterized in that the upper wall of said cap is canted at an acute angle to a horizontal plane passing through said cylindrical skirt of said cap.

3. A child resistant dispensing closure as defined in claim 1 further characterized in that the height of said protective flange relative to said upper wall is greater in the vicinity of said rib on said spout than in the vicinity of the discharge opening in said spout.

* * * * *